United States Patent [19]

Lohoefer

[11] Patent Number: 4,979,182

[45] Date of Patent: Dec. 18, 1990

[54] DEVICE FOR POSITIONING AND MELTING ELECTRICALLY CONDUCTIVE MATERIALS WITHOUT A RECEPTACLE

[75] Inventor: Georg Lohoefer, Aachen, Fed. Rep. of Germany

[73] Assignee: Deutsche Forschungsanstalt fur Luft-und Raumfahrt eV, Cologne, Fed. Rep. of Germany

[21] Appl. No.: 408,775

[22] Filed: Sep. 18, 1989

[30] Foreign Application Priority Data

Sep. 30, 1988 [DE] Fed. Rep. of Germany ..... 3833255

[51] Int. Cl.[5] ..... H05B 6/32

[52] U.S. Cl. ..... 373/138; 219/7.5

[58] Field of Search ..... 373/138, 139, 140, 144, 373/146, 147–150; 219/7.5

[56] References Cited

U.S. PATENT DOCUMENTS 2,686,864 8/1954 Wroughton et al. ..... 219/7.5

FOREIGN PATENT DOCUMENTS 3639973 6/1988 Fed. Rep. of Germany .

*Primary Examiner*—Roy N. Envall, Jr.

*Attorney, Agent, or Firm*—Spensley Horn Jubas & Lubitz

[57] ABSTRACT

Two coils, between which a sample is kept in a contactless suspended state, are connected to separate power sources, at least one of which comprises a phase shifter. Both power sources are controlled by a common oscillation generator. If both currents in the coils are in phase, a magnetic dipole-field of high heating capacity is obtained. If the two currents in the coils are in counterphase, a quadrupole-field is obtained, which generates a high positioning force. By modifying the phase difference, it is possible to generate optional superpositions of the dipole-field and the quadrupole-field, whereby the parts of heating capacity and positioning capacity can be varied.

4 Claims, 1 Drawing Sheet

DEVICE FOR POSITIONING AND MELTING ELECTRICALLY CONDUCTIVE MATERIALS WITHOUT A RECEPTACLE

The invention relates to a device for positioning and melting electrically conductive materials without a receptacle.

1. Field of the Invention

2. Description of Related Art

It is known to contactlessly melt metals or alloys between two vertically separated coils, through which a high frequency alternating current flows in respectively opposite directions. The coils have a double function They serve as positioning coils for holding the sample in the melting area, and they generate eddy currents in the sample by magnetic induction, thereby heating the sample. A sample, arranged under zero-gravity conditions and thus not submitted to any timely constant exterior forces, is fixed in the magnetic field of both coils at the point at which the combined magnetic fields of both coils is weakest, or forced back to that point by small mechanic shocks In doing so, however, the metal sample is located in an area, where the value of magnetic flux density and, thus, also the heat generated by the eddy currents, is lowest. The heating efficiency of a coil arrangement in which a high frequency current flows through the coils in opposite directions and in phase, which thereby generate a magnetic quadrupole-field, is very low, whereas the positioning forces are comparatively high.

In order to obtain not only high positioning forces, but also a strong heating effect, German Patent Publication No. 36 39 973 A1, in addition to the coils generating the positioning field, provides at least one further coil surrounding the melting area, through which a high frequency current of a higher frequency flows. This further coil serves as a heating coil for a contactless heating of the sample. Since the strength of the magnetic field generated by this coil is greatest in the area of the sample held by the positioning field, the energy of the alternating current flowing in this coil is transformed into melting heat within the sample. However, it is a disadvantage that the two coils generating the positioning field are located very close to the heating coil so that a rather high magnetic field strength prevails in the area between the heating coil and a respective positioning coil. This has the effect that the positioning coils are heated by the heating coils to almost the same degree as the sample itself. This heat has to be cooled down and is lost. On the other hand, the heating coil screens off a larger part of the fields of the positioning coils from the sample, thereby significantly reducing their force efficiency, so that a considerable part of the power applied to the positioning coils is also transformed into useless heat.

It is an object of the present invention to provide a device that allows a melting and a positioning of a sample with low heat dissipation and high efficiency.

SUMMARY OF THE INVENTION

The device of the present invention in its preferred embodiment, relates with only two coils that serve as positioning coils and heating coils at the same time. If the alternating currents flow in phase in both coils, a high frequency magnetic dipole-field of high field intensity and high heat generation occurs in the sample. If the currents in the coils flow in counterphase directions, a magnetic quadrupole-field of comparatively low field intensity over a high gradient of field intensity occurs in the sample. By selecting phase shifts between 0° and 180°, superposed dipole- and quadrupole-fields may be generated. The smaller the phase difference, the greater the dipole part of the combined magnetic field and the smaller the quadrupole part. The dipole part has mainly a heat generating effect, whilst that of the quadrupole part is mainly a positioning one.

The invention makes use of the fact that the heat P generated in the sample per time and volume unit is proportional to $\vec{B}^2$:

$$P = k_1 . \vec{B}^2,$$

wherein $k_1$ is a positive proportionality constant and $\vec{B}$ is the magnetic flux density.

The force $\vec{F}$ exerted on the sample per volume unit is $$\vec{F} \times k_2(-\text{ grad } \vec{B}^2).$$

Thus, this force is proportional to the gradient of the flux density, $k_2$ being the positive proportionality constant. With the dipole-field, P is high and $\vec{F}$ is low in the area of the sample, whereas, with the quadrupole-field, P is low and $\vec{F}$ is high in that area.

The dipole and the quadrupole parts may be superposed in a selectable relationship by means of the two power sources generating currents of the same frequency but of variable phase differences in the two coils, it being possible in extreme cases to operate with a pure dipole-field (phase difference=0) or a pure quadrupole-field (phase difference=180°).

The device according to the present invention is particularly suited for melting and/or cooling electrically conductive materials under conditions of reduced gravity. Its main field of application is the performance of metallurgic tests in spacecrafts. It is of particular importance to avoid contact between the sample and the walls of a melting pot or the like, if the object is to cool a sample to a temperature far below the melting temperature, without the sample's solidifying, since walls of melting pots are nuclei of crystallization. The device of the present invention allows both a melting of the sample and a stable positioning of the sample when cooling it. The improved electric efficiency of the device is a main advantage over known devices. This is of particular importance for applications in space, since there the disposable amount of electric energy is limited.

According to the present invention, both power sources may be controlled by a common oscillation generator. This ensures that both power sources operate at the same frequency. The oscillations from the oscillation generator can be easily phase-shifted in the power sources by means of phase shifting circuits. The phase shifters may be, e.g., all-pass filters.

Each of the two coils forms a power oscillating circuit together with a corresponding capacitor. The frequency of the oscillation generator should preferably correspond to the resonant frequency of the two power oscillating circuits. Preferably, both coils and capacitors are of the same design to ensure a maximum similarity of the respective resonant frequencies.

BRIEF DESCRIPTION OF THE DRAWINGS

The following is a detailed description of an embodiment of the invention with respect to the accompanying drawings. In the Figures

DESCRIPTION OF THE PREFERRED EMBODIMENT

Figure 1:
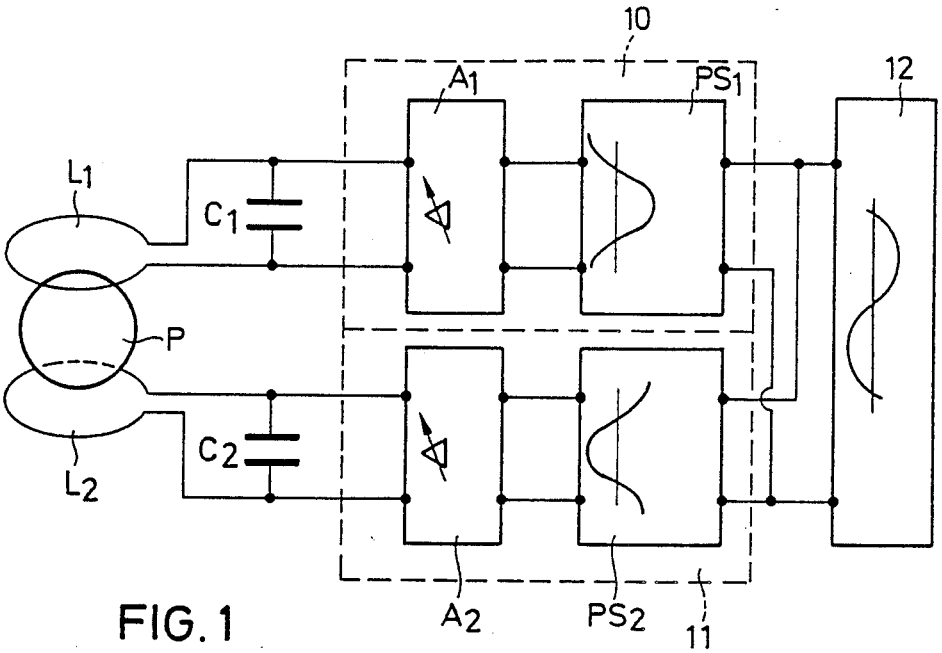
FIG. 1 is a schematic illustration of the device.

The device illustrated in FIG. 1 comprises two parallel coils $L_1$ and $L_2$, the axes of which coincide and which are axially spaced apart. The sample P, held in a suspended state by the quadrupole part of the combined magnetic fields of the coils, is located in the space between coils $L_1$ and $L_2$. The coil $L_1$ is connected in parallel to a capacitor $C_1$ and coil $L_2$ is connected in parallel to a capacitor $C_2$. Each of the oscillating circuits formed by coil $L_1$ and capacitor $C_1$ and coil $L_2$ and capacitor $C_2$, respectively, is connected to a power source 10 and 11, respectively. Power source 10 comprises a phase shifter $PS_1$, the output of which controls an amplifier $A_1$, and power source 11 comprises a phase shifter $PS_2$, the output of which controls an amplifier $A_2$. The output of amplifier $A_1$ is connected to coil $L_1$ and capacitor $C_1$. and the output of amplifier $A_1$ is connected to coil $L_2$ and capacitor $C_2$ The windings of coils $L_1$ and $L_2$ consist of copper pipe through which a coolant flows. The amplification factors of amplifiers $A_1$ and $A_2$ are individually adjustable, as are the angles of phase shifting by phase shifters $PS_1$ and $PS_2$.

The output signal of an oscillation generator 12 is commonly supplied to both phase shifters $PS_1$ and $PS_2$.

In order to keep up the fixed frequency and phase relationship that has to prevail between the alternating currents in both oscillating circuits $L_1$, $C_1$, and $L_2$, $C_2$, both power sources 10 and 11 are driven by their common oscillation generator 12, i.e., amplifiers $A_1$ and $A_2$ generate forced oscillations in the power oscillating circuits having the frequency of the oscillation generator 12. In order to obtain minimum losses in the amplification, the frequency given by oscillation generator 12 should not differ, or differ only slightly, from the resonant frequency of the power oscillating circuits. However, since this resonant frequency is also dependent of the conductivity of the respective sample present between the coils, the frequency of the frequency generator 12 has to be correspondingly variable.

Figure 2:
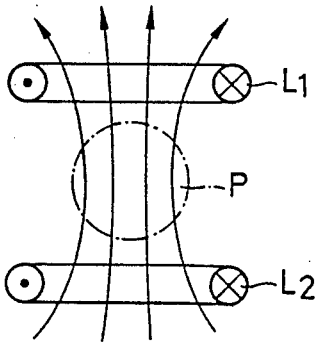
FIG. 2 is a side elevational view of a preferred embodiment of the coils in the dipole-mode with the magnetic field illustrated.

By adjusting one of phase shifters $PS_1$ or $PS_2$, the phase difference between the oscillations in both coils $L_1$ and $L_2$ can be changed. FIG. 2 illustrates the case, where the phase difference is zero. The same amount of alternating current, having the same frequency and phase position, flows in both coils so that both coils $L_1$ and $L_2$ generate a temporally oscillating magnetic dipole-field of high field-intensity in the area of the sample P, which serves to efficiently heat or melt the sample. The magnetic field generated according to FIG. 2 is a dipole-field. Since the flux density B is particularly high in the area of the sample P, an efficient heating of the sample is obtained.

Figure 3:
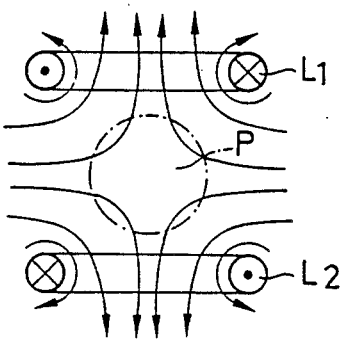
FIG. 3 is a side elevational view of the coils in the quadrupole-mode with the magnetic field illustrated.

FIG. 3 illustrates the other extreme, wherein the phases of the currents in the two coils $L_1$ and $L_2$ are shifted by 180°. The magnetic field is a quadrupole-field with a high gradient of flux density in the peripheral zones of the sample P. Thus, this field has a positioning effect on the sample, while producing but few heat. The state illustrated in FIG. 3 particularly suited, if a molten sample is to cool contactlessly.

Any phase difference between 0° and 180° presents a superposing of both fields. The smaller the phase difference, the larger the dipole part of the combined magnetic field and the smaller the quadrupole part.

What is claimed:

1. A device for melting and positioning electrically conductive materials, comprising a coil arrangement of two coils arranged on opposite sides of a melting area, through which coils high frequency currents of the same frequency flow, characterized in that both coils are connected to separate power sources, the relative phase positions of which are variable in a range from 0° to 180°.

2. The device according to claim 1, wherein both power sources are controlled by a common oscillation generator, at least one of said power sources comprising a phase shifter.

3. A device for positioning and melting electrically conductive materials, comprising:

a first coil, a second coil, the first coil and the second coil being arranged on substantially opposite sides of a melting area, a first power source connected to the first coil, a second power source connected to the second coil, the first power source and the second power source generating currents of the same frequency but of variable phase difference, the phase difference being variable in a range between 0° and 180°.

4. The device according to claim 3, wherein at least one of the power sources comprises a phase shifter and further comprising a common oscillation generator for controlling the first power source and the second power source.

* * * * *